United States Patent [19]

Shirai et al.

[11] Patent Number: 4,788,120

[45] Date of Patent: Nov. 29, 1988

[54] LIGHT RECEIVING MEMBER FOR USE IN ELECTROPHOTOGRAPHY HAVING AN AMORPHOUS SILICON LAYER

[75] Inventors: Shigeru Shirai; Keishi Saito; Takayoshi Arai; Minoru Kato; Yasushi Fujioka, Nagahama, all of Japan

[73] Assignee: Canon Kabushiki Kaisha, Tokyo, Japan

[21] Appl. No.: 165,401

[22] Filed: Feb. 16, 1988

Related U.S. Application Data

[63] Continuation of Ser. No. 604,572, Jan. 26, 1987, abandoned.

[30] Foreign Application Priority Data

Jan. 20, 1986 [JP] Japan ..... 61-010387

[51] Int. Cl.[4] ..... G03G 5/085

[52] U.S. Cl. ..... 430/66; 430/67; 430/62; 430/95

[58] Field of Search ..... 430/66, 67, 62, 84, 430/95

[56] References Cited

U.S. PATENT DOCUMENTS 4,265,991 5/1981 Hirai et al. ..... 430/67

*Primary Examiner*—John L. Goodrow

*Attorney, Agent, or Firm*—Fitzpatrick, Cella, Harper & Scinto

[57] ABSTRACT

There is provided an improved light receiving member for use in electrophotography comprising a substrate for electrophotography and a light receiving layer constituted by a photoconductive layer and a surface layer, the photoconductive layer being formed of an amorphous material containing silicon atoms as the main constituent atoms and at least one kind selected from hydrogen atoms and halogen atoms and the surface layer being formed of an amorphous material containing silicon atoms, carbon atoms and hydrogen atoms, and the amount of the hydrogen atoms contained in the surface layer being in the range of 41 to 70 atomic %.

28 Claims, 6 Drawing Sheets

LIGHT RECEIVING MEMBER FOR USE IN ELECTROPHOTOGRAPHY HAVING AN AMORPHOUS SILICON LAYER

This application is a continuation, of application Ser. No. 004,572, filed on Jan. 20, 1987, now abandoned.

FIELD OF THE INVENTION

This invention relates to an improved light receiving member for use in electrophotography which is sensitive to electromagnetic waves such as light (which herein means in a broader sense those lights such as ultra-violet rays, visible rays, infrared rays, X-rays and γ-rays).

BACKGROUND OF THE INVENTION

For the photoconductive material to constitute a light receiving layer in a light receiving member for use in electrophotography, it is required to be highly sensitive, to have a high SN ratio [photocurrent (Ip)/dark current (Id)], to have absorption spectrum characteristics suited for the spectrum characteristics of an electromagnetic wave to be irradiated, to be quickly responsive and to have a desired dark resistance. It is also required to be not harmful to living things as well as man upon use.

Especially, it is where it is the light receiving member is to be applied in an electrophotographic machine for use in office then, causing no pollution is indeed important.

From this standpoint, public attention has been focused on light receiving members comprising amorphous materials containing silicon atoms (hereinafter referred to as "a-Si"), for example, as disclosed in Offenlegungsschriftes Nos. 2746967 and 2855718 which disclose use of the light receiving member as an image-forming member in electrophotography.

For the conventional light receiving members comprising a-Si materials, there have been made improvements in their optical, electric and photoconductive characteristics such as dark resistance, photosensitivity, and photoresponsiveness, use-environmental characteristics, economic stability and durability.

However, there are still further improvements to be made in their characteristics in the synthesis situation in order to make such light receiving members practically usable.

For example, when such a such conventional light receiving member is employed in the light receiving member for use in electrophotography with the aim to raise the photosensitivity and dark resistance, there is often observed a residual voltage on the conventional light receiving member upon. When it is repeatedly used for a long period of time, fatigues due to the repeated use will accumulate and to cause the so-called ghost phenomena producing residual images.

Further, in the preparation of the light receiving layer of the conventional light receiving member for use in electrophotography using an a-Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in the light receiving layer.

However, the resulting light receiving layer sometimes becomes accompanied with defects on the electrical characteristics, photoconductive characteristics and/or breakdown voltage according to the way of the incorporation of said constituents to be employed.

That is, in the case of using the light receiving member having such light receiving layer, the life of a photocarrier generated in the layer with the irradiation of light is not sufficient, the inhibition of a charge injection from the side of the substrate in a dark layer region is not sufficiently carried out, and image defects likely due to a local breakdown phenomenon which is so-called "white oval marks on half-tone copies" or other image defects likely due to abrasion upon using a blade for the cleaning which is so-called "white line" are apt to appear on the transferred images on a paper sheet.

Further, in the case where the above light receiving member is used in a very moist atmosphere, or in the case where after being placed in that atmosphere it is used, the so-called "image flow" sometimes appears on the transferred images on a paper sheet.

In consequence, it is necessary not only to make a further improvement in an a-Si material itself but also to form such a light receiving member so as not to invite any of the foregoing problems.

SUMMARY OF THE INVENTION

The object of this invention is to provide a light receiving member for use in electrophotography which has a light receiving layer mainly composed of a-Si, free from the foregoing problems and capable of satisfying various requirements in electrophotography.

That is, the main object of this invention is to provide a light receiving member for use in electrophotography which has a light receiving layer formed of a-Si, such that electrical, optical and photoconductive properties are always substantially stable and do not depend on the working environment, and which is excellent in resisting optical fatigue, causes no degradation upon repeatedly use, is excellent in durability and moisture-proofness and exhibits no or hardly any residual voltage.

Another object of this invention is to provide a light receiving member for use in electrophotography which has a light receiving layer formed of a-Si which is adheres well with a substrate on which the layer is disposed or between each of the laminated layers, and which is dense and stable in view of the structural arrangement and is of high quality.

A further object of this invention is to provide a light receiving member for use in electrophotography which has a light receiving layer formed of a-Si which exhibits a sufficient charge-maintaining function in the electrification process of forming electrostatic latent images and exhibits excellent electrophotographic characteristics when it is used in electrophotographic method.

A still further object of this invention is to provide a light receiving member for use in electrophotography which has a light receiving layer formed of a-Si which invites neither an image defect nor an image flow on the resulting visible images on a paper sheet upon repeated use after a long period of time and which gives highly resolved visible images with clearer half-tone which are highly dense and of high quality.

Other objects of this invention are to provide a light receiving member for use in electrophotography having a light receiving layer formed of a-Si which, has, a high photosensitivity, high S/N ratio and can withstand high electrical voltage withstanding property.

The present inventors have made earnest studies for overcoming the foregoing problems on the conventional light receiving members for use in electrophotography and attaining the objects as described above and, as a result, have accomplished this invention based on the finding as described below.

That is, in order to overcome the foregoing problems on the conventional light receiving member for use in electrophotography and attaining the above-mentioned objects, the present inventors have made various studies while focusing on its surface layer. As a result, the present inventors have found that when the surface layer is formed of an amorphous material containing silicon atoms, carbon atoms and hydrogen atoms and the content of the hydrogen atoms is controlled in the range between 41 and 70 atomic %, those problems on the conventional light receiving member for use in electrophotography can be satisfactorily eliminated and the above-mentioned objects can be effectively attained.

Accordingly, this invention is to provide a light receiving member for use in electrophotography which has a light receiving layer comprising a photoconductive layer formed of an amorphous material containing silicon atoms as the main constituent atoms and at least one kind selected from hydrogen atoms and halogen atoms, and if necessary, oxygen atoms and/or nitrogen atoms [hereinafter referred to as "a-Si(H,X)" or "a-Si(H,X)(O,N)"] and a surface layer formed of an amorphous material containing silicon atoms, carbon atoms and hydrogen atoms (hereinafter referred to as "a-Si:C:H") in which the amount of the hydrogen atoms to be contained is ranging in the range of 41 to 70 atomic %.

The light receiving member having the above-mentioned light receiving layer for use in electrophotography according to this invention is free from the foregoing problems of conventional light receiving members for use in electrophotography, has a wealth of practically applicable excellent electric, optical and photoconductive characteristics and is accompanied with an excellent durability and satisfactory environmental characteristics.

Particularly, the light receiving member for use in electrophotography according to this invention has substantially stable electric characteristics without depending on the working circumstances, maintains a high photosensitivity and a high S/N ratio and does not invite any undesirable influence due to residual voltage even when it is repeatedly used for a long period of time. In addition, it has sufficient moisture resistance and optical fatigue resistance, and causes neither degradation upon repeating use nor any defect on breakdown voltage.

Because of this, according to the light receiving member for use in electrophotography, even upon repeated use for a long period of time, highly resolved visible images with clearer half tone which are highly dense and quality are stably obtained.

DETAILED DESCRIPTION OF THE INVENTION

Figure 1:
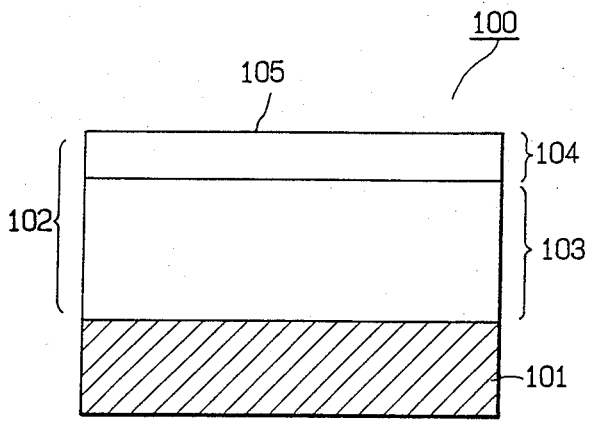
FIG. 1 is a schematic view illustrating the typical layer constitution of a representative light receiving member for use in electrophotography according to this invention.
Figure 2:
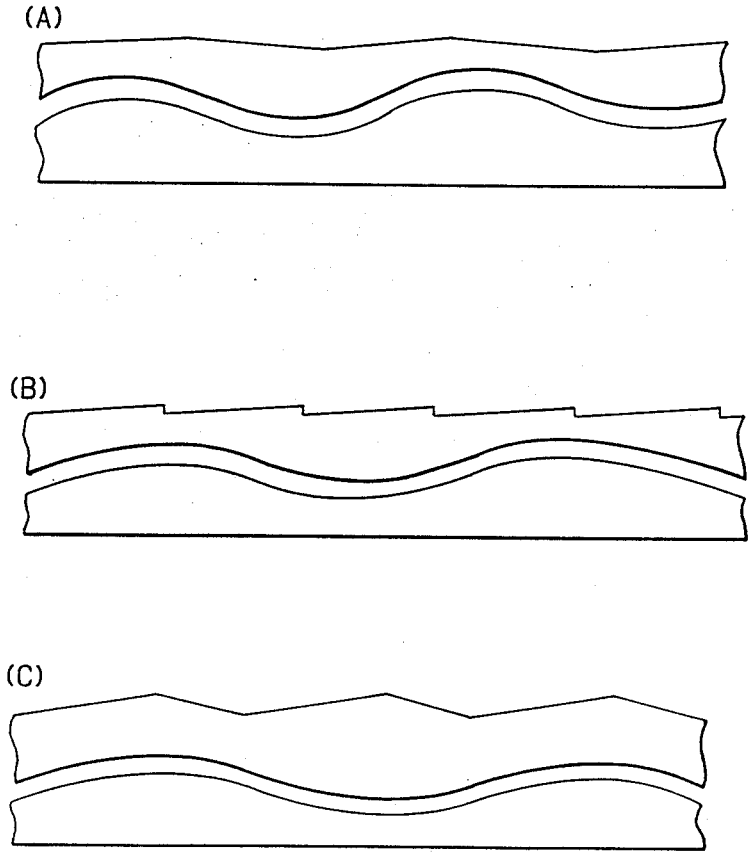
FIG. 2(A) through FIG. 2(C) are schematic views for examples of the shape at the surface of the substrate in the light receiving member for use in electrophotography according to this invention.

Representative embodiments of the light receiving member for use in electrophotography according to this invention will now be explained more specifically referring to the drawings. The description is not intended to limit the scope of this invention.

A representative light receiving member for use in electrophotography according to this invention is as shown in FIG. 1, in which is shown a light receiving member 100 comprising a substrate 101 and a light receiving layer 102 constituted by a photoconductive layer 103 which is formed of an a-Si(H,X) material or an a-Si(H,X)(O,N) material and a surface layer 104 having a free surface 105 which is formed of an a-Si:C:H material containing 41 to 70 atomic % of hydrogen atoms.

For the above-mentioned light receiving member for use in electrophotography according to this invention, it is possible to dispose a contact layer between the substrate and the photoconductive layer in order to enhance the close bondability of the light receiving layer with the substrate. In that case, as the contact layer, a layer composed of $Si_3N_4$, $SiO_2$ or SiO or a layer composed of an amorphous material containing silicon atoms, at least one kind selected from hydrogen atoms and halogen atoms, and at least one kind selected from nitrogen atoms and oxygen atoms may be optionally disposed.

Substrate 101 (or 301)

The substrate 101 for use in this invention may either be electroconductive or insulative. The electroconductive support can include, for example, metals such as NiCr, stainless steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1 in continuous high speed reproduction, it is desirably configurated into an endless belt or cylindrical form. The thickness of the support member is properly determined so that the light receiving member as desired can be formed. In the case where flexibility is required for the light receiving member, it can be made as thin as possible within a range capable of sufficiently providing the function as the substrate. However, the thickness is usually greater than 10 μm in view of the fabrication and handling or mechanical strength of the substrate.

And, it is possible for the surface of the substrate to be uneven in order to eliminate occurrence of defective images caused by a so-called interference fringe pattern being apt to appear in the formed images in the case where the image formation is carried out using coherent monochromatic light such as laser beams.

In that case, the uneven surface shape of the substrate can be formed by the grinding work with means of an appropriate cutting tool, for example, having a V-form bite.

That is, said cutting tool is firstly fixed to the predetermined position of milling machine or lathe, then, for example, a cylindrical substrate is moved regularly in the predetermined direction while being rotated in accordance with the predetermined program to thereby obtain a surfacetreated cylindrical substrate of a surface having irregularities in reverse V-form with a desirable pitch and depth.

The irregularities thus formed at the surface of the cylindrical substrate form a helical structure along the center axis of the cylindrical substrate. The helical structure making the reverse V-form irregularities of the surface of the cylindrical substrate may be double or treble. Or otherwise, it may be of a cross-helical structure.

Further, the irregularities at the surface of the cylindrical substrate may be composed of said helical structure and a delay line formed along the center axis of the cylindrical substrate. The cross-sectional form of the convex of the irregularity formed at the substrate surface is in a reverse V-form in order to attain controlled unevenness of the layer thickness in the minute column for each layer to be formed and secure desired close bondability and electric contact between the substrate and the layer formed directly thereon.

And it is desirable for the reverse V-form to be an equilateral triangle, right-angled triangle or inequilateral triangle form. Among these triangle forms, equilateral triangle form and right-angled triangle form are most preferred.

Each dimension of the irregularities to be formed at the substrate surface under the controlled conditions is properly determined having a due regard on the following points.

That is, firstly, a layer composed of a-Si(H,X) to constitute a light receiving layer is structurally sensitive to the surface state of the layer to be formed and the layer quality is apt to largely change in accordance with the surface state.

Therefore, it is necessary for the dimension of the irregularity to be formed at the substrate surface to be determined not to invite any decrease in the layer quality of the layer composed of a-Si(H,X).

Secondly, should there exist extreme irregularities on the free surface of the light receiving layer, cleaning in the cleaning process after the formation of visible images becomes difficult to sufficiently carry out. In addition, in the case of carrying out the cleaning with a blade, the blade will be soon damaged.

From the viewpoints of avoiding the problems in the layer formation and the electrophotographic processes and from the conditions to prevent occurrence of the problems due to interference fringe patterns, the pitch of the irregularity to be formed at the substrate surface is preferably 0.3 to 500 μm, more preferably 1.0 to 200 μm, and, most preferably, 5.0 to 50 μm.

As for the maximum depth of the irregularity, it is preferably 0.1 to 5.0 μm, more preferably 0.3 to 3.0 μm, and, most preferably, 0.6 to 2.0 μm.

And when the pitch and the depth of the irregularity lie respectively in the above-mentioned range, the inclination of the slope of the dent (or the linear convex) of the irregularity is preferably 1° to 20°, more preferably 3° to 15°, and, most preferably, 4° to 10°.

Further, as for the maximum figure of a thickness difference based on the ununiformity in the layer thickness of each layer to be formed on such substrate surface, in the meaning within the same pitch, it is preferably 0.1 to 2.0 μm, more preferably 0.1 to 15 μm, and, most preferably, 0.2 μm to 1.0 μm.

In alternative, the irregularity at the substrate surface may be composed of a plurality of fine spherical dimples which are more effective in eliminating occurrence of defective images caused by the interference fringe patterns especially in the case of using coherent monochromatic light such as laser beams.

In that case, the scale of each of the irregularities composed of a plurality of fine spherical dimples is smaller than the resolving power required for the light receiving member for use in electrophotography.

Figure 4:
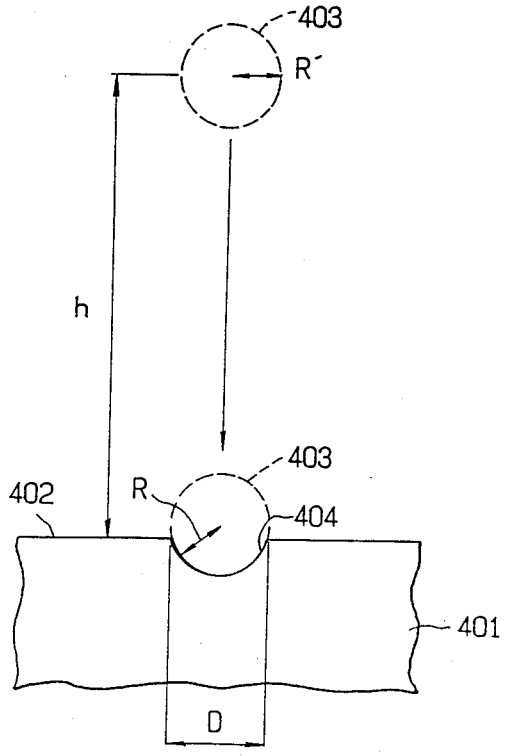
FIGS. 4 through 5 are schematic explanatory views of a preferred method for preparing the substrate having the preferred surface used in the light receiving member shown in FIG. 3.
Figure 5:
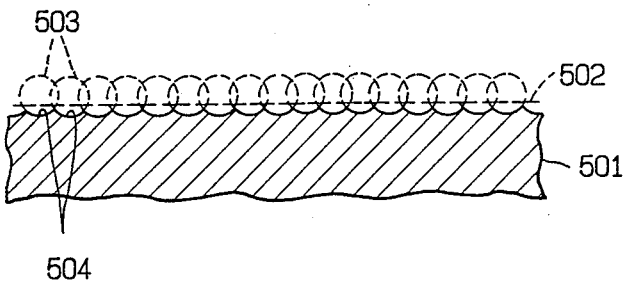

A typical method of forming the irregularities composed of a plurality of fine spherical dimples at the substrate surface will be hereunder explained referring to FIGS. 4 and 5.

FIG. 4 is a schematic view for a typical example of the shape at the surface of the substrate in the light receiving member for use in electrophotography according to this invention, in which a portion of the uneven shape is enlarged. In FIG. 4, are shown a support 401, a support surface 402, a rigid true sphere 403, and a spherical dimple 404.

FIG. 4 also shows an example of the preferred methods of preparing the surface shape as mentioned above. That is, the rigid true sphere 403 is caused to fall gravitationally from a position at a predetermined height above the substrate surface 402 and collide against the substrate surface 402 to thereby form the spherical dimple 404. A plurality of fine spherical dimples 404 each substantially of an identical radius of curvature R and of an identical width D can be formed to the substrate surface 402 by causing a plurality of rigid true spheres 403 substantially of an identical diameter R′ to fall from identical height h simultaneously or sequentially.

FIG. 5 shows a typical embodiment of a substrate formed with the uneven shape composed of a plurality of spherical dimples at the surface as described above.

In the embodiment shown in FIG. 5, a plurality of dimples pits 504, 504, . . . substantially of an identical radius of curvature and substantially of an identical width are formed while being closely overlapped with each other thereby forming an uneven shape regularly by causing to fall a plurality of spheres 503, 503, . . . regularly and substantially from an identical height to different positions at the surface 502 of the support 501. In this case, it is naturally required for forming the dimples 504, 504, . . . overlapped with each other that the spheres 503, 503, . . . are gravitationally dropped such that the times of collision of the respective spheres 503 to the support 502 are displaced from each other.

By the way, the radius of curvature R and the width D of the uneven shape formed by the spherical dimples at the substrate surface of the light receiving member for use in electrophotography according to this invention constitute an important factor for effectively attaining the advantageous effect of preventing occurrence of the interference fringe in the light receiving member for use in electrophotography according to this invention. The present inventors carried out various experiments and, as a result, found the following facts.

That is, if the radius of curvature R and the width D satisfy the following equation:

$$\frac{D}{R} \geqq 0.035$$

0.5 or more Newton rings due to the sharing interference are present in each of the dimples. Further, if they satisfy the following equation:

$$\frac{D}{R} \geqq 0.055$$

one or more Newton rings due to the sharing interference are present in each of the dimples.

From the foregoing, it is preferred that the ratio D/R is greater than 0.035 and, preferably, greater than 0.055 for dispersing the interference fringes resulted throughout the light receiving member in each of the dimples thereby preventing occurrence of the interference fringe in the light receiving member.

Further, it is desired that the width D of the unevenness formed by the scraped dimple is about 500 μm at the maximum, preferably, less than 200 μm and, more preferably less than 100 μm.

Figure 3:
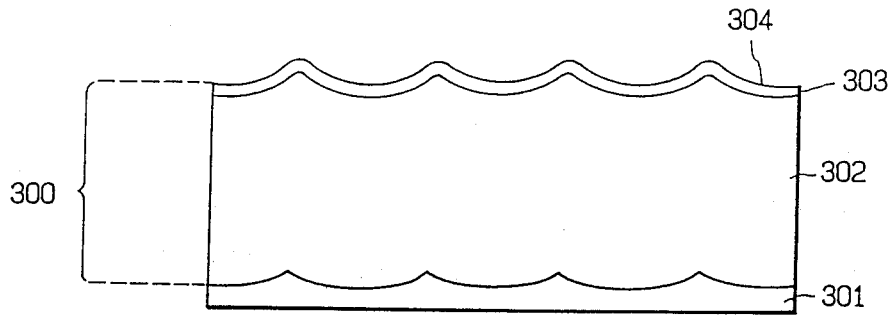
FIG. 3 is a schematic view for a preferred example of the light receiving member for use in electrophotography according to this invention which has a light receiving layer as shown in FIG. 1 formed on the substrate having a preferred surface.

A typical example of the light receiving member for use in electrophotography prepared using the above-mentioned substrate having an uneven surface with the irregularities composed of a plurality of fine spherical dimples is as shown in FIG. 3, in which are shown a light receiving layer 300 constituted by a photoconductive layer 302 which is formed of an a-Si(H,X) material or an a-Si(H,X)(O,N) material and a surface layer 303 having a free surface which is formed of an a-Si:C:H material containing 41 to 70 atomic % of hydrogen atoms, and said substrate 301.

Photoconductive Layer 103 (or 302)

The photoconductive layer 103 (or 302) is disposed on the substrate 101 (or 301) as shown in FIG. 1 (or FIG. 3).

The photoconductive layer is formed of an a-Si(H,X) material or an a-Si(H,X)(O,N) material.

The photoconductive layer has the semiconductor characteristics as under mentioned and shows a photoconductivity against irradiated light (i) p-type semiconductor characteristics containing an acceptor only or both the acceptor and a donor in which the relative content of the acceptor is higher;
(ii) p-type semiconductor characteristics: the content of the acceptor (Na) is lower or the relative content of the acceptor is lower in the case (i);
(iii) n-type semiconductor characteristics: containing a donor only or both the donor and an acceptor in which the relative content of the donor is higher;
(iv) n-type semiconductor characteristics: the content of donor (Nd) is lower or the relative content of the acceptor is lower in the case (iii); and
(v) i-type semiconductor characteristics: NaδNdδ0 or NaδNd.

In order for the photoconductive layer to be a desirable type selected from the above-mentioned types (i) to (v), it can be carried out by doping a p-type impurity, an n-type impurity or both the impurities with the photoconductive layer to be formed during its forming process while controlling the amount of such impurity.

As the element to be such impurity to be contained in the photoconductive layer, the so-called impurities in the field of the semiconductor can be mentioned, and those usable herein can include atoms belonging to the group III of the periodical table that provide p-type conductivity (hereinafter simply referred to as "group III atom") or atoms belonging to the group V of the periodical table that provide n-type conductivity (hereinafter simply referred to as "group V atom"). Specifically, the group III atoms can include B (boron), Al (aluminum), Ga (gallium), In (indium) and Tl (thallium). The group V atoms can include, for example, P (phosphor), As (arsenic), Sb (antimony) and Bi (bismuth). Anong these elements, B, Ga, P and As are particularly preferred.

The amount of the group III atoms or the group V atoms to be contained in the photoconductive layer is preferably $1\times10^3$ to $3\times10^2$ atomic ppm, more preferably, $5\times10^3$ to $1\times10^2$ atomic ppm, and, most preferably, $1\times10^2$ to 50 atomic ppm.

In the photoconductive layer, oxygen atoms or/and nitrogen atoms can be incorporated in the range as long as the characteristics required for that layer are not hindered.

In the case of incorporating oxygen atoms or/and nitrogen atoms in the entire layer region of the photoconductive layer, its dark resistance and close bondability with the substrate are improved.

The amount of oxygen atoms or/and nitrogen atoms to be incorporated in the photoconductive layer is desired to be relatively small not to deteriorate its photoconductivity.

In the case of incorporating nitrogen atoms in the photoconductive layer, its photosensitivity in addition to the above advantages may be improved when nitrogen atoms are contained together with boron atoms therein.

The amount of one kind selected from nitrogen atoms (N), and oxygen atoms (0) or the sum of the amounts for two kinds of these atoms to be contained in the photoconductive layer is preferably $5\times10^{-4}$ to 30 atomic %, more preferably, $1\times10^{-2}$ to 20 atomic %, and, most preferably, $2\times10^{-2}$ to 15 atomic %.

The amount of the hydrogen atoms (H), the amount of the halogen atoms (X) or the sum of the amounts for the hydrogen atoms and the halogen atoms (H+X) to be incorporated in the photoconductive layer is preferably 1 to 40 atomic %, more preferably, 5 to 30 atomic %.

The halogen atom (X) includes, specifically, fluorine, chlorine, bromine and iodine. And among these halogen atoms, fluorine and chlorine are particularly preferred.

The thickness of the photoconductive layer is an important factor in order for the photocarriers generated by the irradiation of light having desired spectral characteristics to be effectively transported, and it is appropriately determined depending upon the desired purpose.

It is, however, also necessary that the layer thickness be determined in view of relative and organic relationships in accordance with the amounts of the halogen atoms and hydrogen atoms contained in the layer or the characteristics required in the relationship with the thickness of other layer. Further, it should be determined also in economical point of view such as productivity or mass productivity. In view of the above, the thickness of the photoconductive layer is preferably 1 to 100 μm, more preferably, 1 to 80 μm, and, most preferably, 2 to 50 μm.

Surface Layer 104 (or 303)

The surface layer 104 (or 303) having the free surface 105 (or 304) is isposed on the photoconductive layer 103 (or 302) to attain the objects chiefly of moisture resistance, deterioration resistance upon repeating use, electrical voltage withstanding property, use environmental characteristics and durability for the light receiving member for use in electrophotography according to this invention.

The surface layer is formed of the amorphous material containing silicon atoms as the constituent atoms which are also contained in the layer constituent amorphous material for photoconductive layer, so that the chemical stability at the interface between the two layers is sufficiently secured.

Typically, the surface layer is formed of an amorphous material containing silicon atoms, carbon atoms and hydrogen atoms (hereinafter referred to as "A-$(Si_xC_{1-x})_yH_{1-y}$", $x>0$ and $y<1$).

It is necessary for the surface layer for the light receiving member for use in electrophotography according to this invention to be carefully formed in order for that layer to bring about the characteristics as required.

That is, a material containing silicon atoms (Si), carbon atoms (C) and hydrogen atoms (H) as the constituent elements is structually extended from a crystalline state to an amorphous state which exhibit electrophysically the properties from conductiveness to semiconductiveness and insulativeness, and other properties from photoconductiveness to non-photo conductiveness according to the kind of a material.

Therefore, in the formation of the surface layer, appropriate layer forming conditions are required to be strictly chosen under which a desired surface layer composed of A-$(Si_xC_{1-x})_y$:$H_{1-x}$ having the characteristics as required may be effectively formed.

For instance, in the case of disposing the surface layer with aiming chiefly at improvements in its electrical voltage withstanding property, the surface layer composed of A-$(Si_xC_{1-x})_y$: $H_{1-y}$ is so formed that it exhibits a significant electrical insulative behavior in use environment.

In the case of disposing the surface layer with aiming at improvements in repeating use characteristics and use environmental characteristics, the surface layer composed of A-$Si_xC_{1-x})_y$:$H_{1-y}$ is so formed that it has certain sensitivity to irradiated light although the electrical insulative property would be somewhat decreased.

The amount of carbon atoms and the amount of hydrogen atoms respectively to be contained in the surface layer of the light receiving member for use in electrophotography according to this invention are important factors as well as the surface layer forming conditions in order to make the surface layer accompanied with desired characteristics to attain the objects of this invention.

The amount of the carbon atoms (C) to be incorporated in the surface layer is preferably $1\times10^{-3}$ to 90 atomic %, and, most preferably, 10 to 80 atomic % respectively to the sum of the amount of the silicon atoms and the amount of the carbon atoms.

The amount of the hydrogen atoms to be incorporated in the surface layer is preferably 41 to 70 atomic %, more preferably 41 to 65 atomic %, and, most preferably, 45 to 60 atomic % respectively to the sum of the amount of all the constituent atoms to be incorporated in the surface layer.

As long as the amount of the hydrogen atom to be incorporated in the surface layer lies in the above-mentioned range, any of the resulting light receiving members for use in electrophotography becomes wealthy in significantly and practically applicable characteristics and to excel the conventional light receiving members for use in electrophotography in every viewpoint.

That is, for the conventional light receiving member for use in electrophotography, there is known that when there exist certain defects within the surface layer composed of A-$(Si_xC_{1-x})_y$: $H_{1-y}$ (mainly due to dangling bonds of silicon atoms and those of carbon atoms) they give undesirable influences to the electrophotographic characteristics.

For instance, because of such defects, there are often invited deterioration in the electrification characteristics due to charge injection from the side of the free surface, changes in the electrification characteristics due to alterations in the surface structure under certain use environment, for example, high moisture atmosphere, and appearance of residual images upon repeating use due to that an electric charge is injected into the surface layer from the photoconductive layer at the time of corona discharge or at the time of light irradiation to thereby make the electric charge trapped for the defects within the surface layer.

However, the above defects being present in the surface layer of the conventional light receiving member for use in electrophotography which invite various problems as mentioned above can be largely eliminated by controlling the amount of the hydrogen atoms to be incorporated in the surface layer to be more than 41 atomic %, and as a result, the foregoing problems can be almost resolved. In addition, the resulting light receiving member for use in electrophotography becomes to have extremely improved advantages especially in the electric characteristics and the repeating usability at high speed in comparison with the conventional light receiving member for use in electrophotography.

And, the maximum amount of the hydrogen atoms to be incorporated in the surface layer is necessary to be 70 atomic %. That is, when the amount of the hydrogen atoms exceeds 70 atomic %, the hardness of the surface layer is undesirably decreased so that the resulting light receiving member becomes such that can not be repeatedly used for a long period of time.

In this connection, it is an essential factor for the light receiving member for use in electrophotography of this invention that the surface layer contains the amount of the hydrogen atoms ranging in the above-mentioned range.

For the incorporation of the hydrogen atoms in said particular amount in the surface layer, it can be carried out by appropriately controlling the related conditions such as the flow rate of a starting gaseous substance, the temperature of a substrate, discharging power and the gas pressure.

Specifically, in the case of where the surface layer is formed of A-$(Si_xC_{1-x})_y$:$H_{1-y}$, "x" is preferably 0.1 to 0.99999, more preferably 0.1 to 0.99, and, most preferably, 0.15 to 0.9. And the "y" is preferably 0.3 to 0.59, more preferably 0.35 to 0.59, and, most preferably, 0.4 to 0.55.

The thickness of the surface layer in the light receiving member according to this invention is appropriately determined depending upon the desired purpose.

It is, however, also necessary that the layer thickness be determined in view of relative and organic relationships in accordance with the amounts of the silicon atoms, hydrogen atoms and other kind atoms contained in the layer or the characteristics required in the relationship with the thickness of other layer. Further, it should be determined also in economical point of view such as productivity or mass productivity. In view of the above factors, the thickness of the surface layer is preferably 0.003 to 30 μm, more preferably, 0.004 to 20 μm, and, most preferably, 0.005 to 10 μm.

By the way, the thickness of the light receiving layer 102 constituted by the photoconductive layer 103 (or 302 in FIG. 3) and the surface layer 104 (or 303 in FIG. 3) in the light receiving member for use in electrophotography according to this invention is appropriately determined depending upon the desired purpose.

In any case, said thickness is appropriately determined in view of relative and organic relationships between the thickness of the photoconductive layer and that of the surface layer so that the various desired characteristics for each of the photoconductive layer and the surface layer in the light receiving member for use in electrophotography can be sufficiently brought about upon the use to effectively attain the foregoing objects of this invention.

And, it is preferred that the thickness of the photoconductive layer and the surface layer be determined so that the ratio of the former versus the latter lies in the range of some hundred times to some thousand times.

Specifically, the thickness of the light receiving layer 102 is preferably 3 to 100 μm, more preferably 5 to 70 μm, and, most preferably, 5 to 50 μm.

Preparation of Layers

The method of forming the light receiving layer 102 of the light receiving member 100 will be now explained.

Each of the photoconductive layer 103 and the surface layer 104 to constitute the light receiving layer of the light receiving member of this invention is properly prepared by vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the layers having desired properties are relatively easy, and hydrogen atoms, halogen atoms and other atoms can be introduced easily together with silicon atoms. The glow discharging method and the sputtering method may be used together in one identical system.

Preparation of Photoconductive Layer

Basically, when a photoconductive layer 103 constituted with A-Si(H,X) is formed, for example, by the glow discharging method, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of A-Si(H,X) is formed on the surface of a substrate placed in the deposition chamber.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms, and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$. The use of the gaseous or gasifiable silicon halide as described above is particularly advantageous since the layer constituted with halogen atom-containing A-Si:H can be formed with no additional use of the gaseous starting silicon hydride material for supplying Si.

In the case of forming a photoconductive layer constituted with an amorphous material containing halogen atoms, typically, a mixture of a gaseous silicon halide substance as the starting material for supplying Si and a gas such as Ar, $H_2$ and He is introduced into the deposition chamber having a substrate in a predetermined mixing ratio and at a predetermined gas flow rate, and the thus introduced gases are exposed to the action of glow discharge to thereby cause a gas plasma resulting in forming said layer on the substrate.

And, for incorporating hydrogen atoms in said layer, an appropriate gaseous starting material for supplying hydrogen atoms can be additionally used.

Now, the gaseous starting material usable for supplying hydrogen atoms can include those gaseous or gasifiable materials, for example, hydrogen gas ($H_2$), halides such as HF, HCl, HBr, and HI, silicon hydrides such as $SiH_4$, $Si_2H_6$, $Si_3H_8$, and $Si_4H_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms (H), which are extremely effective in view of the control for the electrical or photoelectronic properties, can be controlled with ease. Then, the use of the hydrogen halide or the halogen-substituted silicon hydride as described above is particularly advantageous since the hydrogen atoms (H) are also introduced together with the introduction of the halogen atoms.

The amount of the hydrogen atoms (H) and/or the amount of the halogen atoms (X) to be contained in a layer are adjusted properly by controlling related conditions, for example, the temperature of a substrate, the amount of a gaseous starting material capable of supplying the hydrogen atoms or the halogen atoms into the deposition chamber and the electric discharging power.

In the case of forming a layer composed of A-Si(H,X) by the reactive sputtering process, the layer is formed on the substrate by using an Si target and sputtering the Si target in a plasma atmosphere.

To form said layer by the ion-plating process, the vapor of silicon is allowed to pass through a desired gas plasma atmosphere. The silicon vapor is produced by heating polycrystal silicon or single crystal silicon held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms in accordance with the sputtering process, a feed gas to liberate hydrogen is introduced into the deposition chamber in which a plasma atmosphere of the gas is produced. The feed gas to liberate halogen atoms includes the above-mentioned halogen-containing silicon compounds.

For example, in the case of the reactive sputtering process, the layer composed of A-Si(H,X) is formed on the substrate by using an Si target and by introducing a halogen-atom introducing gas and $H_2$ gas, if necessary, together with an inert gas such as He or Ar into the deposition chamber to thereby form a plasma atmosphere and then sputtering the Si target.

In order to form a layer constituted with an amorphous material composed of a-Si(H,X) further incorporated with the group III atoms or the group V atoms using a glow discharging, sputtering or ion plating process, the starting material for introducing the group III or group V atoms is used together with the starting material for forming a-Si(H,X) upon forming the a-Si(H,X) layer while controlling the amount of them in the layer to be formed.

For instance, in the case of forming a layer composed of a-Si(H,X) containing the group III or group V atoms, namely A-SiM(H,X) in which M stands for the group III or group V atoms, by using the glow discharging, the starting gases material for forming the a-SiM(H,X) are introduced into a deposition chamber in which a substrate being placed, optionally being mixed with an inert gas such as Ar or He in a predetermined mixing ratio, and the thus introduced gases are exposed to the action of glow discharge to thereby cause a gas plasma resulting in forming a layer composed of a-SiM(H,X) on the substrate.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

Referring to the starting material for introducing the group V atoms and, specifically to, the phosphor atom introducing materials, they can include, for example, phosphor hydrides such as $PH_3$ and $P_2H_6$ and phosphor halide such as $PH_4I$, $PF_3$, $PF_5$, $PCl_3$, $PCl_5$, $PBr_3$, $PBr_5$ and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $SiCl_3$ and $BiBr_3$ can also be mentioned to as the effective starting material for introducing the group V atoms.

In order to form a layer containing nitrogen atoms using the glow discharging process, the starting material for introducing nitrogen atoms is added to the material selected as required from the starting materials for forming said layer as described above. As the starting material for introducing nitrogen atoms, most of gaseous or gasifiable materials which contain at least nitrogen atoms as the constituent atoms can be used.

For instance, it is possible to use a mixture of a gaseous starting material containing silicon atoms (Si) as the constituent atoms, a gaseous starting material containing nitrogen atoms (N) as the constituent atoms and, optionally, a gaseous starting material containing hydrogen atoms (H) and/or halogen atoms (X) as the constituent atoms in a desired mixing ratio, or a mixture of a starting gaseous material containing silicon atoms (Si) as the constituent atoms and a gaseous starting material containing nitrogen atoms (N) and hydrogen atoms (H) as the constituent atoms also in a desired mixing ratio.

Alternatively, it is also possible to use a mixture of a gaseous starting material containing nitrogen atoms (N) as the constituent atoms and a gaseous starting material containing silicon atoms (Si) and hydrogen atoms (H) as the constituent atoms.

The starting material that can be used effectively as the gaseous starting material for introducing the nitrogen atoms (N) used upon forming the layer containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

The layer containing nitrogen atoms may be formed through the sputtering process by using a single crystal or polycrystalline Si wafer or $Si_3N_4$ wafer or a wafer containing Si and $Si_3N_4$ in admixture as a target and sputtering them in various gas atmospheres.

In the case of using an Si wafer as a target, for instance, a naseous starting material for introducing nitrogen atoms and, as required, hydrogen atoms and/pr halogen atoms is diluted optionally with a dilution gas, and introduced into a sputtering deposition chamber to form gas plasmas with these gases and the Si wafer is sputtered.

Alternatively, Si and $Si_3N_4$ may be used as individual targets or as a single target comprising Si and $Si_3N_4$ in admixture and then sputtered in the atmosphere of a dilution gas or in a gaseous atmosphere containing at least hydrogen atoms (H) and/or halogen atoms (X) as the constituent atoms as for the sputtering gas. As the gaseous starting material for introducing nitrogen atoms, those gaseous starting materials for introducing the nitrogen atoms described previously shown in the example of the glow discharging can be used as the effective gas also in the case of the sputtering.

In order to form a layer containing oxygen atoms using the glow discharging process, the gaseous starting material for introducing the oxygen atoms is added to the material selected as required from the starting materials for forming said layer as described above.

As the starting material for introducing oxygen atoms, most of those gaseous or gasifiable materials which contain at least oxygen atoms as the constituent atoms.

For instance, it is possible to use a mixture of a gaseous starting material containing silicon atoms (Si) as the constituent atoms, a gaseous starting material containing oxygen atoms (O) as the constituent atoms and, as required, a gaseous starting material containing hydrogen atoms (H) and/or halogen atoms (X) as the constituent atoms in a desired mixing ratio, a mixture of gaseous starting material containing silicon atoms (Si) as the constituent atoms and a gaseous starting material containing oxygen atoms (O) and hydrogen atoms (H) as the constituent atoms in a desired mixing ratio, or a mixture of gaseous starting material containing silicon atoms (Si) as the constituent atoms and a gaseous starting material containing silicon atoms (Si), oxygen atoms (O) and hydrogen atoms (H) as the constituent atoms.

Further, it is also possible to use a mixture of a gaseous starting material containing silicon atoms (Si) and hydrogen atoms (H) as the constituent atoms and a gaseous starting material containing oxygen atoms (O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

In the case of forming a layer containing oxygen atoms by way of the sputtering process, it may be carried out by sputtering a single crystal or polycrystalline Si wafer or $SiO_2$ wafer, or a wafer containing Si and $SiO_2$ in admixture is used as a target and sputtered them in various gas atmospheres.

For instance, in the case of using the Si wafer as the target, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafer is sputtered.

Alternatively, sputtering may be carried out in the atmosphere of a dilution gas or in a gas atmosphere containing at least hydrogen atoms (H) and/or halogen atoms (X) as constituent atoms as a sputtering gas by using individually Si and $SiO_2$ targets or a single Si and $SiO_2$ mixed target. As the gaseous starting material for introducing the oxygen atoms, the gaseous starting material for introducing the oxygen atoms shown in the examples for the glow discharging process as described above can be used as the effective gas also in the sputtering.

For the formation of a photoconductive layer of the light receiving member of this invention by means of the glow discharging process, sputtering process or ion plating process, the content of the oxygen atoms, carbon atoms, nitrogen atoms or the group III or V atoms to be introduced into a-Si(H,X) is controlled by controlling the gas flow rate and the ratio of the gas flow rate of the starting materials entered in the deposition chamber.

The conditions upon forming the photoconductive layer, for example, the temperature of the substrate, the gas pressure in the deposition chamber and the electric discharging power are important factors for obtaining a desirable light receiving member having desired properties and they are properly selected while considering the functions of the layer to be formed. Further, since these layer forming conditions may be varied depending on the kind and the amount of each of the atoms contained in the photoconductive layer, the conditions have to be determined also taking the kind or the amount of the atoms to be contained into consideration.

Specifically, the temperature of the support is preferably from 50° to 350° C. and, most preferably, from 100° to 250° C. The gas pressure in the deposition chamber is preferably from 0.01 to 1 Torr and, most preferably, from 0.1 to 0.5 Torr. Further, the electrical discharging power is preferably from 0.005 to 50 W/cm$^2$, more preferably, from 0.01 to 30 W/cm$^2$ and, most preferably, from 0.01 to 20 W/cm$^2$.

However, the actual conditions for forming the layer such as the temperature of substrate, discharging power and the gas pressure in the deposition chamber can not usually be determined with ease independent of each other. Accordingly, the conditions optimal for the layer formation and desirably determined based on relative and organic relationships for forming the photoconductive layer having desired properties.

Preparation of Surface Layer

The surface layer 104 in the light receiving member for use in electrophotography according to this invention is constituted with an amorphous material composed of A-$(Si_xC_{1-x})_y$: $H_{1-y}$[$x<0$, $y>1$] which contains 41 to 70 atomic % of hydrogen atoms and is disposed on the abovementioned photoconductive layer.

The surface layer can be properly prepared by vacuum deposition method utilizing the discharge phenomena such as glow discharging, sputterin or ion plating wherein relevant gaseous starting materials are selectively used as well as in the above-mentioned cases for preparing the photoconductive layer.

However, the glow discharging method or sputtering method is suitable since the control for the condition upon preparing the surface layer having desired properties are relatively easy, and hydrogen atoms and carbon atoms can be introduced easily together with silicon atoms. The glow discharging method and the sputtering method may be used together in one identical system.

Basically, when a layer constituted with A-$(Si_xC_{1-x})_y$: $H_{1-y}$ is formed, for example, by the glow discharging method, gaseous starting material capable of supplying silicon atoms (Si) are introduced together with a gaseous starting material for introducing hydrogen atoms (H) and/or halogen atoms (X) into a deposition chamber the inside pressure of which can be reduced, glow discharge is generated in the deposition chamber, and a layer constituted with A-$(Si_xC_{1-x})_y$: $H_{1-y}$ containing 41 to 70 atomic % of hydrogen atoms is formed on the surface of a substrate placed in the deposition chamber.

As for the gaseous starting materials for supplying silicon atoms (Si) and/or hydrogen atoms (H), the same gaseous materials as mentioned in the above cases for preparing photoconductive layer can be used as long as they do not contain any of halogen atoms, nitrogen atoms and oxygen atoms.

That is, the gaseous starting material usable for forming the surface layer can include almost any kind of gaseous or gasifiable materials as far as it contains one or more kinds selected from silicon atoms hydrogen atoms and carbon atoms as the constituent atoms.

Specifically, for the preparation of the surface layer, it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si) in the glow discharging process as described above.

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-C4H10) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In the case of forming the surface layer by way of the sputtering process, it is carried out by using a single crystal or polycrystalline Si wafer, a C (graphite) wafer or a wafer containing a mixture of Si and C as a target and sputtering them in a deisred gas atmosphere.

In the case of using, for example, an Si wafer as a target, a gaseous starting material for introducing carbon atoms (C) is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

The conditions upon forming the surface layer constituted with an amorphous material composed of A-$(Si_xC_{1-x})_y$: $H_{1-y}$ which contains 41 to 71 atomic % of hydrogen atoms, for example, the temperature of the substrate, the gas pressure in the deposition chamber and the electric discharging power are important factors for obtaining a desirable surface layer having desired properties and they are properly selected while considering the functions of the layer to be formed. Further, since these layer forming conditions may be varied depending on the kind and the amount of each of the atoms contained in the light receiving layer, the conditions have to be determined also taking the kind or the amount of the atoms to be contained into consideration.

Specifically, the temperature of the substrate is preferably from 50° to 350° C. and, most preferably, from 100° to 300° C. The gas pressure in the deposition chamber is preferably from 0.01 to 1 Torr and, most preferably, from 0.1 to 0.5 Torr. Further, the electrical discharging power is preferably from 10 to 1000 W/cm$^2$, and, most preferably, from 20 to 500 W/cm$^2$.

However, the actual conditions for forming the surface layer such as the temperature of a substrate, discharging power and the gas pressure in the deposition chamber can not usually be determined with ease independent of each other. Accordingly, the conditions optimal to the formation of the surface layer are desirably determined based on relative and organic relationships for forming the surface layer having desired properties.

DESCRIPTION OF THE PREFERRED EMBODIMENTS

The invention will be described more specifically while referring to Examples 1 through 7, but the invention is not intended to limit the scope only to these Examples.

Figure 6:
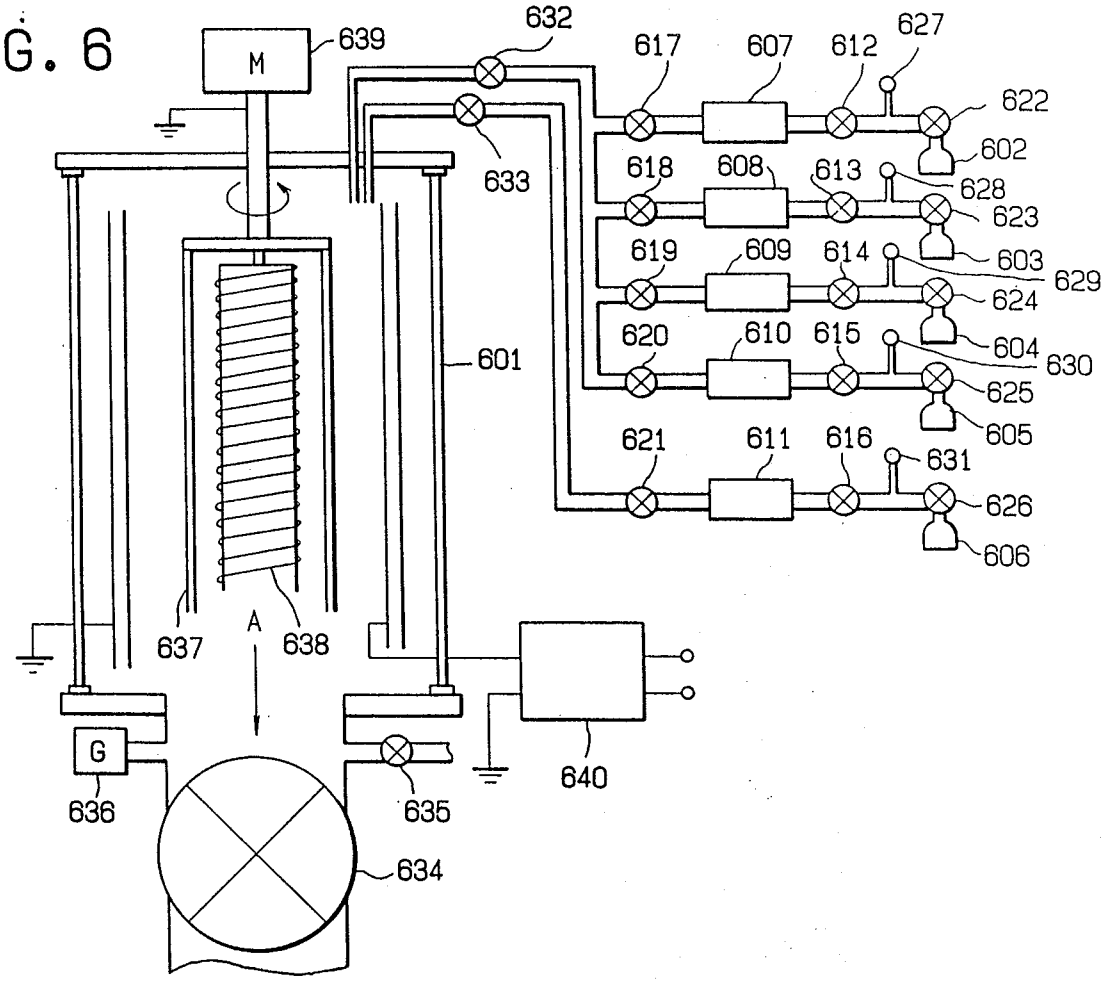
FIG. 6 is a schematic explanatory view of a fabrication apparatus for preparing the light receiving member for use in electrophotography according to this invention.
Figure 7:
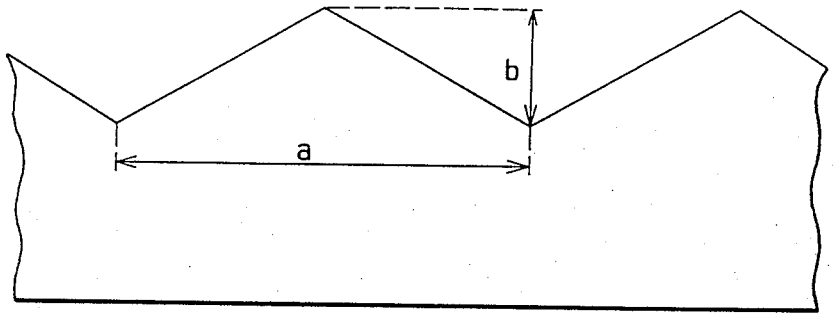
FIGS. 7 and 8 are schematic portion views respectively illustrating the shape of the surface of the substrate in the light receiving member in Examples 6 and 7.

In each of the Examples, the photoconductive layer 103 and the surface layer 104 were respectively formed using the glow discharging fabrication apparatus shown in FIG. 6.

Gas reservoirs 602, 603, 604, 605, and 606 illustrated in the figure are charged with gaseous starting materials for forming the respective layers in the light receiving member for use in electrophotography according to this invention, that is, for instance, $SiH_4$ gas (99.999% purity) in the reservoir 602, $B_2H_6$ gas (99.999% purity) diluted with $H_2$ (hereinafter referred to as "$B_2H_6/H_2$ gas") in the reservoir 603, $Si_2H_6$ (99.999% purity) in the reservoir 604, $H_2$ gas (99.999% purity) in the reservoir 605, and $CH_4$ gas in the reservoir 606.

Prior to the entrance of these gases into a reaction chamber 601, it is confirmed that valves 622 through 626 for the gas reservoirs 602 through 606 and a leak valve 635 are closed and that inlet valves 612 through 616, exit valves 617 through 621, and sub-valves 632 and 633 are opened. Then, a main valve 634 is at first opened to evacuate the inside of the reaction chamber 601 and gas piping.

Then, upon observing that the reading on the vacuum 636 became about $5\times10^{-6}$ Torr, the sub-valves 632 and 633 and the exit valves 617 through 621 are closed.

Now, reference is made to an example in the case of forming the photoconductive layer 103 or an Al cylinder as a substrate 637, $SiH_4$ gas from the gas reservoir 602 and $B_2H_6/H_2$ gas from the gas reservoir 603 are caused to flow into mass flow controllers 607 and 608, respectively by gradually opening the inlet valves 612 and 613, controlling the pressure of exit pressure gauges 627 and 628 to 1 $kg/cm^2$. Subsequently, the exit valves 617 and 618, and the sub-valve 632 are gradually opened to enter the gases into the reaction chamber 601.

In this case, the exit valves 617 and 618 are adjusted so as to attain a desired value for the ratio among the $SiH_4$ gas flow rate and the $B_2H_6/H_2$ gas flow rate, and the opening of the main valve 634 is adjusted while observing the reading on the vacuum gauge 636 so as to obtain a desired value for the pressure inside the reaction chamber 601. Then, after confirming that the temperature of the Al cylinder 637 has been set by a heater 638 within a range from 50° to 350° C., a power source 640 is set to a predetermined electrical power to cause glow discharging in the reaction chamber 601 while controlling the above gas flow rates to thereby form the photoconductive layer 103.

In the case where halogen atoms are incorporated in the photoconductive layer 103, for example, $SiF_4$ gas is fed into the reaction chamber 601 in addition to the gases as mentioned above.

And it is possible to further increase the layer forming speed according to the kind of a gas to be selected. For example, in the case where the photoconductive layer 103 is formed using $Si_2H_6$ gas in stead of the $SiH_4$ gas, the layer forming speed can be increased by a few holds and as a result, the layer productivity can be rised.

In order to form the surface layer 104 on the resulting photoconductive layer, for example, $SiH_4$ gas, $CH_4$ gas and if necessary, a dilution gas such as $H_2$ gas are introduced into the reaction chamber 601 by operating the corresponding valves in the same manner as in the case of forming the photoconductive layer and glow discharging is caused therein under predetermined conditions to thereby form the surface layer.

In that case, the amount of the carbon atoms to be incorporated in the surface layer can be properly controlled by appropriately changing the flow rate for the $SiH_4$ gas and that for the $CH_4$ gas respectively to be introduced into the reaction chamber 601. As for the amount of the hydrogen atoms to be incorporated in the surface layer, it can be properly controlled by appropriately changing the flow rate of the $H_2$ gas to be introduced into the reaction chamber 601. All of the exit valves other than those required for upon forming the respective layers are of course closed. Further, upon forming the respective layers, the inside of the system is once evacuated to a high vacuum degree a required by closing the exit valves 617 through 621 while entirely opening the sub-valve 632 and entirely opening the main valve 634.

Further, during the layer forming operation, the Al cylinder as substrate 637 is rotated at a predetermined speed by the action of the motor 639.

EXAMPLE 1

A light receiving member for use in electrophotography having a light receiving layer 102 disposed on an Al cylinder having a mirror grinded surface was prepared under the layer forming conditions shown in Table 1 using the fabrication apparatus shown in FIG. 6.

And, a sample having only a surface layer on the same kind Al cylinder as in the above case was prepared in the same manner for forming the surface layer in the above case using the same kind fabrication apparatus as that shown in FIG. 6.

For the resulting light receiving member (hereinafter, this kind light receiving member is referred to as "drum"), it was set with electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

As for the resulting sample, upper part, middle part and lower part of its image forming part were cut off, and were engaged in quantitative analysis by the conventional organic element analyzer to analize the content of hydrogen atoms in each of the cut-off parts.

The results of the various evaluations and the results of the quantitative analysis of the content of the hydrogen atoms are as shown in Table 2. As Table 2 illustrates, considerable advantages on items of initial eletrification efficiency, defective image flow and sensitivity deterioration were acknowledged.

COMPARATIVE EXAMPLE 1

Except that the layer forming conditions changed as shown in Table 3, the drum and the sample were made under the same fabrication apparatus and manner as Example 1 and were provided to examine the same items. The results are shown in Table 4. As the Table 4 illustrates, much defects on various items were acknowledged compared to the case of Example 1.

EXAMPLE 2 (COMPARATIVE EXAMPLE 2)

With the layer forming conditions of a surface layer changed as shown in Table 5 and the rest of the conditions were the same as in Example 1. Multiple drums and samples for analysis were provided. These drums and samples were surveyed and analyzed by the same procedures as in Example 1. The results were shown in Table 6.

EXAMPLE 3

With the layer forming conditions for a photoconductive layer changed as Table 7 illustrates and the rest of the conditions were the same as in Example 1, multiple drums were provided. These drums were examined by the same procedures as in Example 1. The results were shown in Table 8.

EXAMPLE 4

With the layer forming conditions for a contact layer changed as the figures shown in Table 9, multiple drums having a light receiving layer formed under the same conditions of Example 1 were provided.

Other than this, samples simply having a contact layer were provided. The drums were examined by the same procedures as in Example 1.

As for the samples, a part of each sample was cut off to find out the diffraction pattern corresponding to the Si (111) of diffraction angle of approximately 27 degrees by using X-ray diffraction meter and examined if crystallization would occur. The results are shown in Table 10.

EXAMPLE 5

With the layer forming conditions for a contact layer changed as the figures of Table 11, multiple drums having a light receiving layer formed under the same conditions as in Example 1 are provided. These drums were examined by the same procedures as in Example 1. The results were as shown in Table 12.

EXAMPLE 6

The mirror ground cylinders were supplied for the griding process of cutting tool of various degrees. With the patterns of FIG. 1, various cross section patterns as described in Table 13, multiple cylinders were provided These cylinders were set to the fabrication apparatus of FIG. 6 accordingly, and used to produce drums under the same production conditions of Example 1. The produced drums are evaluated with the conventional electrophotographic copying machine having digital exposure functions and using semiconductor laser of 780 nm wavelength. The results were as shown in Table 14.

EXAMPLE 7

Figure 8:
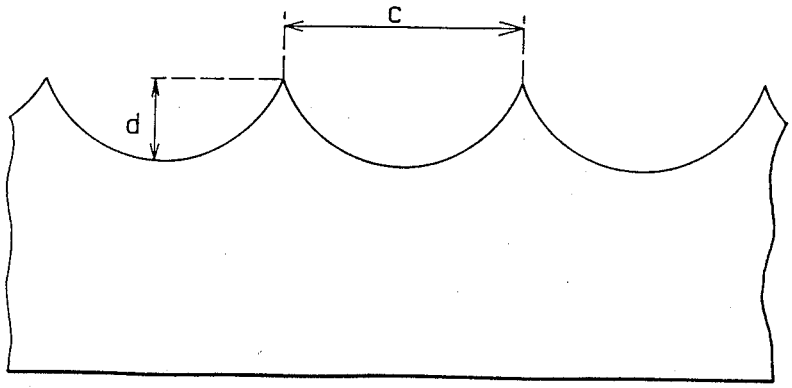

The surface of mirror grounded cylinders were dimple processed by dropping lots of bearing balls. Multiple cylinders having a pattern as shown in FIG. 8 and of cross section pattern of Table 15 were provided. These cylinders were set to the fabrication apparatus of FIG. 6 accordingly and used for the production of drums under the same conditions of Example 1. The produced drums are evaluated by the same electrophotographic copying machine as used in Example 6. The results were as shown in Table 16.

TABLE 1

| Name of layer | Gas used and flow rate (SCCM) | | Substrate temperature (°C.) | RF power (W) | Inner pressure (torr) | Layer thickness (μm) |
|---|---|---|---|---|---|---|
| Photo-conductive layer | $SiH_4$ | 200 | 250 | 300 | 0.35 | 20 |
| | $B_2H_6$ (against $SiH_4$) | 100 ppm | | | | |
| | NO | 4 | | | | |
| Surface layer | $SiH_4$ | 10 | 250 | 200 | 0.45 | 0.5 |
| | $CH_4$ | 500 | | | | |
| | $H_2$ | 500 | | | | |

TABLE 2

| Initial electrification efficiency | Initial sensitivity | Image flow | Residual voltage | Ghost | Defective image | Deterioration of sensitivity | Increase of defective image | Hydrogen content (atomic %) |
|---|---|---|---|---|---|---|---|---|
| ◎ | o | ◎ | o | o | ◎ | ◎ | o | 54 |

◎ very good
o good
Δ practically applicable
x poor

TABLE 3

| Name of layer | Gas used and flow rate (SCCM) | | Substrate temperature (°C.) | RF power (W) | Inner pressure (torr) | Layer thickness (μm) |
|---|---|---|---|---|---|---|
| Photo-conductive layer | $SiH_4$ | 200 | 250 | 300 | 0.3 | 20 |
| | $B_2H_6$ (against $SiH_4$) | 100 ppm | | | | |
| | NO | 4 | | | | |
| Surface layer | $SiH_4$ | 10 | 150 | 100 | 0.7 | 0.5 |
| | $CH_4$ | 500 | | | | |
| | $H_2$ | 1000 | | | | |

TABLE 4

| Initial electrification efficiency | Initial sensitivity | Image flow | Residual voltage | Ghost | Defective image | Deterioration of sensitivity | Increase of defective image | Hydrogen content (atomic %) |
|---|---|---|---|---|---|---|---|---|
| x | o | x | Δ | o | x | o | x | 89 |

◎ very good
o good
Δ practically applicable
x poor

TABLE 5

| Drum No. | 201 | | 202 | | 203 | | 204 | | 205 | | Comparative Example 2 | |
|---|---|---|---|---|---|---|---|---|---|---|---|---|
| Flow rate (current) | $SiH_4$ | 10 | $SiH_4$ | 10 | $SiH_4$ | 10 | $SiH_4$ | 10 | $SiH_4$ | 10 | $SiH_4$ | 10 |
| | $CH_4$ | 500 | $CH_4$ | 500 | $CH_4$ | 500 | $CH_4$ | 500 | $CH_4$ | 500 | $CH_4$ | 500 |

TABLE 5-continued

| Drum No. | 201 | 202 | 203 | 204 | 205 | Comparative Example 2 |
|---|---|---|---|---|---|---|
| (SCCM) | $H_2$ 300 | $H_2$ 500 | $H_2$ 700 | $H_2$ 700 | $H_2$ 700 | $H_2$ 800 |
| Substrate temperature (°C.) | 250 | 250 | 250 | 150 | 150 | 100 |
| RF power (W) | 200 | 100 | 200 | 200 | 100 | 150 |
| Inner pressure (torr) | 0.4 | 0.45 | 0.48 | 0.48 | 0.48 | 0.65 |
| Layer thickness (μm) | 0.5 | 0.5 | 0.5 | 0.5 | 0.5 | 0.5 |

TABLE 6

| Sample No. | Initial electrification efficiency | Initial sensitivity | Image flow | Residual voltage | Ghost | Defective image | Deterioration of sensitivity | Increase of defective image | Hydrogen content (atomic %) |
|---|---|---|---|---|---|---|---|---|---|
| 201 | o | o | o | ◎ | o | o | o | o | 43 |
| 202 | ◎ | o | ◎ | ◎ | ◎ | o | o | o | 58 |
| 203 | ◎ | o | ◎ | o | ◎ | o | o | o | 60 |
| 204 | o | o | ◎ | o | ◎ | o | o | o | 65 |
| 205 | o | o | o | o | o | o | o | o | 68 |
| Comparative Example 2 | x | o | Δ | Δ | Δ | x | o | x | 85 |

◎ . . . very good
o . . . good
Δ . . . practically applicable
x . . . poor

TABLE 7

| Drum No. | 301 | 302 | 303 | 304 | 305 |
|---|---|---|---|---|---|
| Flow rate (current) (SCCM) | $SiH_4$ 200<br>$B_2H_6$ 100 ppm (against $SiH_4$)<br>NO 4 | $SiH_4$ 350<br>$H_2$ 350<br>$B_2H_6$ 200 ppm (against $SiH_4$)<br>NO 6 | $SiH_4$ 350<br>Ar 350<br>$B_2H_6$ 200 ppm (against $SiH_4$)<br>NO 6 | $SiH_4$ 350<br>He 350<br>$B_2H_6$ 200 ppm (against $SiH_4$)<br>NO 6 | $SiH_4$ 200<br>$SiF_4$ 100<br>$H_2$ 300<br>$B_2H_6$ 100 ppm (against $SiH_4$)<br>NO 6 |
| Substrate temperature (°C.) | 250 | 250 | 250 | 250 | 250 |
| RF power (W) | 200 | 300 | 250 | 300 | 350 |
| Inner pressure (torr) | 0.3 | 0.45 | 0.45 | 0.45 | 0.45 |
| Layer thickness (μm) | 20 | 20 | 20 | 20 | 20 |

TABLE 8

| Sample No. | Initial electrification efficiency | Initial sensitivity | Image flow | Residual voltage | Ghost | Defective image | Deterioration of sensitivity | Increase of defective image |
|---|---|---|---|---|---|---|---|---|
| 301 | o | o | ◎ | o | o | ◎ | ◎ | o |
| 302 | o | o | ◎ | ◎ | ◎ | o | o | o |
| 303 | ◎ | o | o | ◎ | o | o | ◎ | o |
| 304 | o | ◎ | o | ◎ | ◎ | o | o | o |
| 305 | ◎ | o | o | o | o | o | ◎ | Δ |

◎ very good
o good
Δ practically applicable
x poor

TABLE 9

| Drum No. | 401 | 402 | 403 |
|---|---|---|---|
| Flow rate (current) (SCCM) | $SiH_4$ 50<br>$H_2$ 600<br>$NH_3$ 500 | $SiH_4$ 50<br>$H_2$ 600<br>NO 500 | $SiH_4$ 50<br>$H_2$ 600<br>$N_2$ 500 |

TABLE 9-continued

| Drum No. | 401 | 402 | 403 |
|---|---|---|---|
| Substrate temperature (°C.) | 350 | 350 | 350 |

TABLE 9-continued

| Drum No. | 401 | 402 | 403 |
|---|---|---|---|
| RF power (W) | 1000 | 1000 | 1000 |
| Inner pressure (torr) | 0.6 | 0.6 | 0.5 |
| Layer thickness (μm) | 0.1 | 0.1 | 0.1 |

TABLE 10

| Sample No. | Initial electrification efficiency | Initial sensitivity | Image flow | Residual voltage | Ghost | Defective image | Deterioration of sensitivity | Increase of defective image | Existence of crystallizability |
|---|---|---|---|---|---|---|---|---|---|
| 401 | ◎ | o | ◎ | ◎ | ◎ | ◎ | o | ◎ | yes |
| 402 | ◎ | o | o | o | ◎ | o | o | ◎ | yes |
| 403 | o | o | ◎ | Δ | ◎ | o | o | ◎ | yes |

◎ very good
o good
Δ practically applicable
x poor

TABLE 11

| Drum No. | 501 | 502 | 503 |
|---|---|---|---|
| Flow rate | $SiH_4$ 50 | $SiH_4$ 50 | $SiH_4$ 50 |
| (current) (SCCM) | $NH_3$ 500 | NO 500 | $N_2$ 500 |
| Substrate temperature (°C.) | 250 | 250 | 250 |
| RF power (W) | 150 | 200 | 200 |
| Inner pressure (torr) | 0.3 | 0.3 | 0.3 |
| Layer thickness (μm) | 0.1 | 0.1 | 0.1 |

TABLE 12

| Sample No. | Initial electrification efficiency | Initial sensitivity | Image flow | Residual voltage | Ghost | Defective image | Deterioration of sensitivity | Increase of defective image |
|---|---|---|---|---|---|---|---|---|
| 501 | o | o | ◎ | o | ◎ | o | o | o |
| 502 | ◎ | o | ◎ | o | ◎ | o | o | ◎ |
| 503 | ◎ | o | o | o | ◎ | o | o | ◎ |

◎ . . . very good
o . . . good
Δ . . . practically applicable
x . . . poor

TABLE 13

| Drum No. | 601 | 602 | 603 | 604 | 605 |
|---|---|---|---|---|---|
| a [μm] | 25 | 50 | 50 | 12 | 12 |
| b [μm] | 0.8 | 2.5 | 0.8 | 1.5 | 0.3 |

TABLE 14

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 601 | ◎ | o | ◎ | Δ | ◎ | ◎ | o | o | Δ | o |
| 602 | ◎ | o | ◎ | o | ◎ | ◎ | o | o | o | Δ |
| 603 | ◎ | o | ◎ | Δ | ◎ | ◎ | o | o | o | Δ |
| 604 | ◎ | o | ◎ | o | ◎ | ◎ | Δ | o | o | o |
| 605 | ◎ | o | ◎ | Δ | ◎ | ◎ | Δ | o | Δ | Δ |

◎ . . . very good
o . . . good
Δ . . . practically applicable
x . . . poor

TABLE 15

| Drum No. | 701 | 702 | 703 | 704 | 705 |
|---|---|---|---|---|---|
| a [μm] | 50 | 100 | 100 | 30 | 30 |
| b [μm] | 2 | 5 | 1.5 | 2.5 | 0.7 |

TABLE 16

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 701 | ◎ | o | ◎ | Δ–o | ◎ | ◎ | o | o | Δ | Δ |
| 702 | ◎ | o | ◎ | o | ◎ | ◎ | Δ | o | o | Δ |
| 703 | ◎ | o | ◎ | Δ | ◎ | ◎ | o | o | o | Δ |
| 704 | ◎ | o | ◎ | o | ◎ | ◎ | Δ | o | Δ | o |

TABLE 16-continued

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 705 | ◎ | o | ◎ | Δ–o | ◎ | ◎ | Δ | o | o | Δ–o |

◎ . . . very good
o . . . good
Δ . . . practically applicable
x . . . poor

What we claim is:

1. A light receiving member for use in electrophotography comprising a substrate for electrophotography and a light receiving layer constituted by a photoconductive layer and a surface layer, the photoconductive layer being formed of an amorphous material containing silicon atoms as the main constituent atoms and at least one kind selected from hydrogen atoms and halogen atoms and the surface layer being formed of an amorphous material containing silicon atoms, carbon atoms and hydrogen atoms, and the amount of the hydrogen atoms contained in the surface layer being in the range of 41 to 70 atomic %.

2. A light receiving member for use in electrophotography according to claim 1, wherein the photoconductive layer contains at least one kind selected from nitrogen atoms and oxygen atoms.

3. A light receiving member for use in electrophotography comprising a substrate for electrophotography, a contact layer and a light receiving layer constituted by a photoconductive layer and a surface layer, the photoconductive layer being formed of an amorphous material containing silicon atoms as the main constituent atoms and at least one kind selected from hydrogen atoms and halogen atoms and the surface layer being formed of an amorphous material containing silicon atoms, carbon atoms and hydrogen atoms, and the amount of the hydrogen atoms contained in the surface layer being in the range of 41 to 70 atomic %.

4. A light receiving member for use in electrophotography according to claim 3, wherein the photoconductive layer contains at least one kind selected from nitrogen atoms and oxygen atoms.

5. A light receiving member for use in electrophotography according to claim 1 or claim 3 wherein the substrate is electrically insulative.

6. A light receiving member for use in electrophotography according to claim 1 or claim 3 wherein the substrate is electroconductive.

7. A light receiving member for use in electrophotography according to claim 1 or claim 3 wherein the substrate is an aluminum alloy.

8. A light receiving member for use in electrophotography according to claim 1 or claim 3 wherein the substrate is in a cylindrical form.

9. A light receiving member for use in electrophotography according to claim 1 or claim 3 wherein the substrate has an uneven surface.

10. A light receiving member for use in electrophotography according to claim 1 or claim 3 wherein the substrate has an irregular surface.

11. A light receiving member for use in electrophotography according to claim 1 or claim 3 wherein the photoconductive layer has p-type semiconductor characteristics.

12. A light receiving member for use in electrophtography according to claim 1 or claim 3 wherein the photoconductive layer has n-type semiconductor characteristics.

13. A light receiving member for use in electrophotography according to claim 1 or claim 3 wherein the photoconductive layer has i-type semiconductor characteristics.

14. A light receiving member for use in electrophotography according to claim 1 or 3 wherein the photocodnuconductive layer contains an element of Group III of the Periodic Table.

15. A light receiving member for use in electrophotography according to claim 14, wherein said element is selected from the group consisting of B, Al, Ga, In or Tl.

16. A light receiving member for use in electrophotography according to claim 14, wherein the amount of said element contained in the photoconductive layer is in the range of $1\times10^3$ to $3\times10^2$ atomic ppm.

17. A light receiving member for use in electrophotography according to claim 1 or claim 3 wherein the photocondutive layer contains an element of Group V of the Periodic Table.

18. A light receiving member for use in electrophotography according to claim 17, wherein said element is selected from the group consisting of P, As, Sb or Bi.

19. A light receiving member for use in electrophotography according to claim 17, wherein the amount of said element contained in the photoconductive layer is in the range of $1\times10^3$ to $3\times10^2$ atomic ppm.

20. A light receiving member for use in electrophotography according to claim 2 or claim 4, wherein the amount of the oxygen atoms contained in the photoconductive layer is in the range of $5\times10^{-4}$ to 30 atomic %.

21. A light receiving member for use in electrophotography according to claim 2 or claim 4, wherein the amount of the nitrogen atoms contained in the photoconductive layer is in the range of $5\times10^{-4}$ to 30 atomic %.

22. A light receiving member for use in elector-photography according to claim 2 or claim 4, wherein the sum of the oxygen atoms and of the nitrogen atoms in the photoconductive layer is in the range of $5\times10^{-4}$ to 30 atomic %.

23. A light receiving member for use in electrophotography according to claim 1 or claim 3, wherein the photoconductive layer contains 1 to 40 atomic % of said hydrogen atoms.

24. A light receiving member for use in electrophotography according to claim 1 or claim 3, wherein the photoconductive layer contains 1 to 40 atomic % of said halogen atoms.

25. A light receiving member for use in electrophotgraphy according to claim 1 or claim 3, wherein the photoconductive layer contains the hydrogen atoms and the halogen atoms in amounts from 1 to 40 atomic %.

26. A light receiving member for use in electrophotography according to claim 1 or claim 3, wherein the thickness of the photoconductive layer is 1 to 100 μm.

27. A light receiving member for use in electrophotography according to claim 1 or claim 3, wherein the thickness of the surface layer is 0.003 to 30 μm.

28. An electrophotographic process comprising:

(1) applying a charge to the light receiving member of claim 1 or claim 3; and (2) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,788,120

DATED : November 29, 1988

INVENTOR(S) : SHIGERU SHIRAI, ET AL.

It is certified that error appears in the above-identified patent and that said Letters Patent is hereby corrected as shown below:

On the Title Page

IN [63] RELATED U.S. APPLICATION DATA

"Ser. No. 604,572, Jan. 26, 1987," should read --Ser. No. 4,572, Jan. 20, 1987,--.

COLUMN 1

Line 28, "it is" should be deleted (both occurrences).

Line 56, "to" should be deleted.

COLUMN 2

Line 64, "which, has," should read --which has--.

COLUMN 3

Line 38, "is accompanied with an" should read --exhibits--.

UNITED STATES PATENT AND TRADEMARK OFFICE

CERTIFICATE OF CORRECTION

PATENT NO. : 4,788,120

DATED : November 29, 1988

INVENTOR(S) : SHIGERU SHIRAI, ET AL.

It is certified that error appears in the above-identified patent and that said Letters Patent is hereby corrected as shown below:

COLUMN 8

Line 1, "characteristics" should read --characteristics :

Line 4, "p-type" should read --$p^-$-type--.

Line 10, "n-type" should read --$n^-$-type--.

COLUMN 9

Line 26, "isposed" should read --disposed--.

Line 59, "$A-(Si_xC_{1-x})_y:H_{1-x}$" should read --$A-(Si_xC_{1-x})_y:H_{1-y}$--.

COLUMN 11

Line 15, " "x" " should read --the "x"--.

COLUMN 16

Line 45, "$A-(Si_xC_{1-x})_y:H_{1-y}[x<0,y>1]$" should read --$A-(Si_xC_{1-x})_y:H_{1-y}[x>0,y<1]$--.

COLUMN 27

Line 67, "electrophtog-" should read --electrophotog- --.

UNITED STATES PATENT AND TRADEMARK OFFICE

CERTIFICATE OF CORRECTION

PATENT NO. : 4,788,120

DATED : November 29, 1988

INVENTOR(S) : SHIGERU SHIRAI, ET AL.

It is certified that error appears in the above-identified patent and that said Letters Patent is hereby corrected as shown below:

COLUMN 28

Line 21, "codnuconductive" should read --conductive--.
Line 51, "elector-" should read --electro- --.
Line 64, "electrophotg-" should read --electrophotog- --.

Signed and Sealed this

Twelfth Day of December, 1989

*Attest:*

JEFFREY M. SAMUELS

*Attesting Officer*

*Acting Commissioner of Patents and Trademarks*